United States Patent [19]

Blaisdell et al.

[11] Patent Number: 4,990,821

[45] Date of Patent: Feb. 5, 1991

[54] MULTICOLOR PICTURE ELEMENT WITH MERGED COLORS

[75] Inventors: Ronald G. Blaisdell, Saugus; Joseph V. Lima, Salem; Robert Y. Pai, Hamilton, all of Mass.

[73] Assignee: GTE Products Corporation, Danvers, Mass.

[21] Appl. No.: 221,538

[22] Filed: Jun. 27, 1988

[51] Int. Cl.[5] ..... H01J 5/16; H01J 61/30; H01J 61/40

[52] U.S. Cl. ..... 313/112; 313/116; 313/318; 313/493; 313/634; 362/242; 362/246

[58] Field of Search ..... 313/493, 610, 116, 318, 313/634, 112; 340/772; 362/246, 242, 243

[56] References Cited

U.S. PATENT DOCUMENTS

| | | | |
|---|---|---|---|
| 1,963,962 | 6/1934 | Barclay | 313/610 X |
| 3,924,227 | 12/1975 | Stolov | 313/112 X |
| 4,300,073 | 11/1981 | Skwirut et al. | 313/634 X |
| 4,426,602 | 1/1984 | Mollet et al. | 315/58 |
| 4,481,442 | 11/1984 | Albrecht et al. | 313/493 |
| 4,559,480 | 12/1985 | Nobs | 315/324 |
| 4,722,028 | 1/1988 | Brannon et al. | 362/242 X |
| 4,743,799 | 5/1988 | Loy | 313/493 |
| 4,786,841 | 11/1988 | Fohl et al. | 313/493 |

FOREIGN PATENT DOCUMENTS

| | | | |
|---|---|---|---|
| 62-31937 | 2/1987 | Japan . | |
| 706592 | 3/1954 | United Kingdom | 362/242 |
| 2145873A | 7/1984 | United Kingdom . | |
| 2167895A | 7/1985 | United Kingdom . | |

*Primary Examiner*—Palmer C. DeMeo

*Attorney, Agent, or Firm*—Wolf, Greenfield & Sacks

[57] ABSTRACT

A plug-in lamp assembly for use as a picture element in large-screen information display systems. The lamp assembly includes red, green and blue discharge lamps for selectively generating different colors. Each discharge lamp has electrical leads extending from a first end and a light output region at a second end. The lamp assembly further includes a base having spaced-apart, plug-in electrical connectors, a cap covering the second ends of the lamps and a sleeve around the discharge lamps and interconnecting the cap and the base. The base provides mechanical support for the discharge lamps and permits easy replacement of the lamp assembly. The sleeve blocks light emitted from the sides of the discharge lamps. The cap includes a diffuser and a filter for altering the output spectrum of one or more of the discharge lamps. The diffuser can be mounted in a spaced relationship to the second ends of the discharge lamps at a distance therefrom selected such that the light from each different color lamp substantially fills the area of the diffuser. As a result, the light outputs from the discharge lamps are merged at the diffuser.

13 Claims, 3 Drawing Sheets

MULTICOLOR PICTURE ELEMENT WITH MERGED COLORS

CROSS REFERENCE TO RELATED APPLICATIONS This application discloses, but does not claim, subject matter which is claimed in U.S. Ser. No. 212,358 filed concurrently herewith and assigned to the assignee of this application.

1. Field of the Invention

This invention relates to lamp assemblies for use in very large screen display systems and, more particularly, to such lamp assemblies that include a diffuser arrangement for merging the colors from red, green and blue low-pressure arc discharge lamps. Each of the lamp assemblies is a picture element of the display system.

2. Background of the Invention

Low-pressure arc discharge lamps have been used for optical display of information, including alphanumerics, graphics and moving or still pictures, on a large screen Such a display consists of a matrix of picture elements, or pixels. Each picture element includes a monochrome light source in the case of a monochrome display. In the case of a color information display, each picture element includes three lamps of the primary colors: red, green and blue. Each lamp is selectively energized on a scale ranging from off to full brightness to produce one of the primary colors or a mixture of primary colors for that picture element.

A large screen display of the above-described type is disclosed in U.S. Pat. No. 4,559,480, issued Dec. 17, 1985 to Nobs. The disclosed display utilizes picture elements each consisting of three discharge tubes coated with different phosphors to produce the primary colors. The disclosed display has sufficient brightness for use in outdoor sports stadiums and the like during the daytime. Such displays have typically utilized compact, generally U shaped fluorescent lamps that are primarily used for general illumination. The envelope includes at least two longitudinally-extending tubes joined together by a transversely extending envelope portion. Examples of such lamps which are commercially available are the "twin tube" and "double twin tube" fluorescent lamps manufactured by GTE Sylvania, Danvers, Mass. Other examples of such lamps are disclosed in U.S. Pat. No. 4,426,602, issued Jan. 17, 1984 to Mollet et al and U.S. Pat. No. 4,481,442, issued Nov. 6, 1984 to Albrecht et al. In these lamps, the surface brightness alone the envelope is substantially constant, and much of the radiation is emitted in a direction that cannot be utilized in the picture display. Low-pressure arc discharge lamps wherein a large portion of the light emitted from the lamp is directed through end faces of parallel tubes are disclosed in pending application Ser. Nos. 064,978, 064,961 and 064,7831, filed June 22, 1987, and assigned to the assignee of the present application. The disclosed lamps can include different color phosphors.

A large screen picture display of the type used in a sports stadium consists of several thousand picture elements, each including three discharge lamps. In the past, the discharge lamps have been individually soldered to circuit boards located at the rear of the display. When one or more of the lamps in the display failed, it was necessary to remove an entire circuit board from the display, to unsolder and remove the defective bulb and then to solder a new lamp in its place. Finally, the circuit board was replaced in the display. Such a procedure was found to be inconvenient in the environment of a sports stadium. The use of connectors for single U-shaped fluorescent lamps is disclosed in the aforementioned Pat. Nos. 4,426,602 and 4,481,442. Such single connectors are not satisfactory for use in picture displays due to the spacing between lamps necessitated by the dimensions of the plug in base. In order to form a picture element having a satisfactory appearance, it is necessary for the red, green and blue lamps to be closely spaced or in contact with each other. Any spacing between the lamps of a pixel degrades the apparent uniformity of the picture display. Furthermore, single lamp connectors are inconvenient in the case of a large screen display due to the large number of single lamps and the possibility of replacing a lamp with the wrong color.

A further difficulty with prior art picture displays has been the necessity for baffling between picture elements Light was emitted through the sides of the lamps in each picture element, causing undesired illumination of adjacent picture elements.

In prior art picture displays of the above-described type, it has been difficult to obtain good quality color at an acceptable cost. Due to the large number of elements in a picture display, it is necessary that the lamps of each picture element be relatively low in cost. When phosphors in an acceptable price range are utilized, the green lamp often appears bluish and the red lamp may be pink. It is desirable in such picture displays to provide high quality Color at an acceptable cost.

A further challenge in large screen picture displays is to provide a picture that has a high quality appearance to viewers close to the display and to viewers that are located far away from the display. It will be understood that in a sports stadium, some of the viewers are likely to be located relatively close to the display screen. Any defects are more apparent to a viewer that is close to the screen.

Depending on the size of the display screen, each picture element may have viewing surface dimensions in the range from less than one inch to about three inches. For viewers that are located a considerable distance from the display, the light from the three lamps of a picture element is combined by the eye and the brain to produce the illusion of a single color. However, for viewers that are relatively close to the display screen, picture elements appear as a collection of spots of different colors. Furthermore, when a straight line or a geometric figure having changes in color along its length is displayed, the offset in the positions of the lamps within each picture element produces a line that is offset at the point where the color changes.

It is a general object of the present invention to provide picture element lamp assemblies for use in large screen information display systems.

It is a further object of the present invention to provide a large screen information display system that has high color quality at close range.

It is yet another object of the present invention to provide a picture element having different color lamps wherein the colors are merged in the picture element output.

It is still another object of the invention to provide a picture element having an output that is uniform in color.

SUMMARY OF THE INVENTION

According to the present invention, these and other objects and advantages are achieved in a lamp assembly for use as a picture element in an information display system. The lamp assembly comprises low pressure arc discharge lamp means for selectively generating multiple Colors, the lamp means having electrical leads extending from a first end thereof and a second end for output of light of different colors from discrete regions thereof. The lamp assembly further comprises a diffuser having a predetermined area and means for mounting the diffuser in a spaced relationship to the second end of the lamp means at a distance therefrom selected such that the light from each different color region of the lamp means substantially fills the area of the diffuser. As a result, the light outputs from the lamp means are merged at the diffuser. Preferably, the plurality of arc discharge lamps includes a red discharge lamp, a green discharge lamp and a blue discharge lamp. Preferably, the distance between the diffuser and the second ends of the discharge lamps is at least as great as the maximum dimension of the diffuser.

In one preferred embodiment, the mounting means comprises a base coupled to the first ends of the discharge lamps for mechanical support and electrical interconnection thereof, a cap for holding the diffuser in spaced relationship to the second ends of the discharge lamps and means for coupling the cap to the base. The means for coupling the cap to the base can comprise a cylindrical sleeve.

According to another preferred embodiment, the mounting means comprises a cap for holding the diffuser in spaced relationship to the second ends of the discharge lamps and means for coupling the cap to the discharge lamps.

Preferably, the cap includes a cylindrical portion between the second ends of the discharge lamps and the diffuser, and the cylindrical portion has a reflecting inside surface for directing light from the discharge lamps through the diffuser. The lamp assembly can further include filter means positioned adjacent to the second ends of the discharge lamps for altering the output spectrum of at least one of the discharge lamps.

By spacing the diffuser from the second ends of the discharge lamps, the light from each discharge lamp approximately fills the area of the diffuser. Thus, the colors from the different discharge lamps are merged together at the diffuser, and the lamp assembly has a uniform color output.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
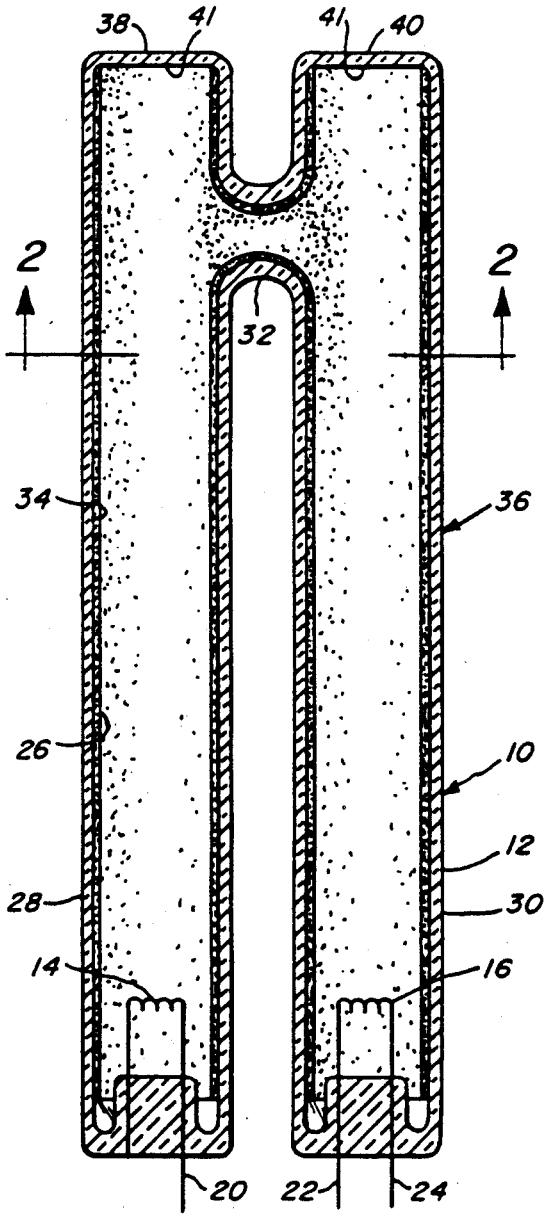
FIG. 1 a cross-sectional view of a discharge lamp suitable for use in the lamp assembly of the present invention.
Figure 2:
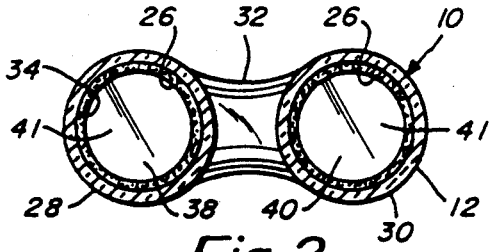
FIG. 2 cross sectional view taken through the line 2—2 of FIG. 1.

Referring to FIGS. 1 and 2, there is illustrated an arc discharge lamp 10 suitable for use in the lamp assembly of the present invention. The discharge lamp 10 is a fluorescent lamp including a sealed envelope 12 containing an ionizable medium including a quantity of mercury and an inert starting gas at low pressure. The envelope 12 can, for example, contain on the order of 1–5 millimeters of mercury, and the starting gas can be argon, krypton, neon or helium, or a mixture of these and other gases. A pair of electrodes 14 and 16 is located within envelope 12 for generating an arc discharge therebetween during operation of the lamp 10. Electrode 14 is an anode, and electrode 16 is a filament-type cathode. Electrical lead 20 is coupled through envelope 12 to electrode 14, and electrical leads 22 and 24 are coupled through envelope 12 to electrode 16. During operation, constant electrical energy is supplied to filament electrode 16, and lamp intensity is controlled by varying the current applied to electrode 14. A phosphor layer 26 within sealed envelope 12 converts ultraviolet radiation generated in the mercury discharge into visible radiation.

Envelope 12 includes first and second longitudinally-extending tubes 28 and 30, respectively. Envelope 12 also includes a transversely extending envelope portion 32 joining the first and second tubes 28 and 30 to form a continuous passage therethrough for the arc discharge. The envelope 12 includes a major body portion 36 and first and second end faces 38 and 40, respectively, associated with the first and second tubes 28 and 30. The phosphor layer 26 is disposed on the internal surface 34 of major body portion 36, but is not disposed on the internal surface of the end faces 38 and 40. Light is emitted primarily through end faces 38 and 40.

Figure 3A:
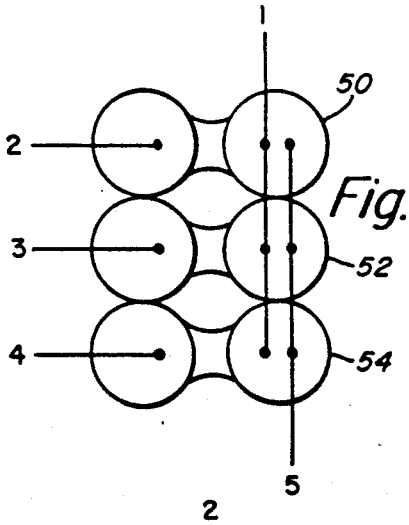
FIG. 3A is a bottom view of one preferred arrangement of twin tube discharge lamps in the lamp assembly.
Figure 3B:
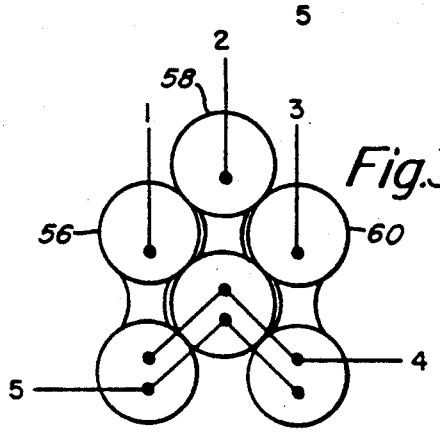
FIG. 3B is a bottom view of another preferred arrangement of twin tube discharge lamps in the lamp assembly.
Figure 3C:
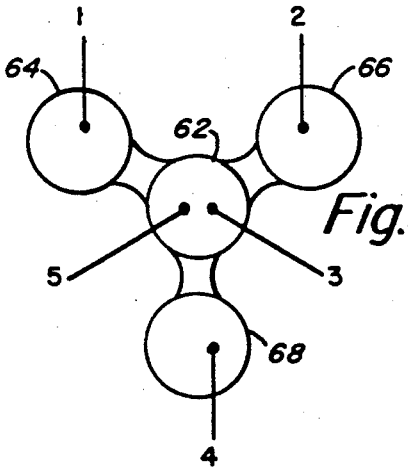
FIG. 3C is a bottom view of a single, tricolor lamp tube configuration.

In order to form a picture element of a picture display, three discharge lamps of the type shown in FIGS. 1 and 2 are typically utilized in a closely spaced arrangement. One preferred arrangement is shown in FIG. 3A, wherein the lamps are viewed from the rear of the picture element. A red twin tube discharge lamp 50, a green twin tube discharge lamp 52 and a blue twin tube discharge lamp 54 are aligned side-by-side and are closely-spaced, preferably contacting each other. A nested arrangement utilizing a red discharge lamp 56, a green discharge lamp 58 and a blue discharge lamp 60 is shown in FIG. 3B In the nested arrangement, the middle discharge lamp 58 is offset from discharge lamps 56 and 60 for a more compact arrangement. A tricolor discharge lamp utilizing a common tube 62 and a plurality of tube members 64, 66 and 58 is shown in FIG. 3C Each of the tubes 64, 66 and 68 is joined to the common tube 62 through a transversely extending envelope portion. The tubes 64, 66 and 68 have red, green and blue phosphors, respectively, to form a triColor picture element discharge lamp. The discharge lamp shown in FIG. 3C is described more fully in the aforementioned pending application Ser. No. 064,731.

Figure 4:
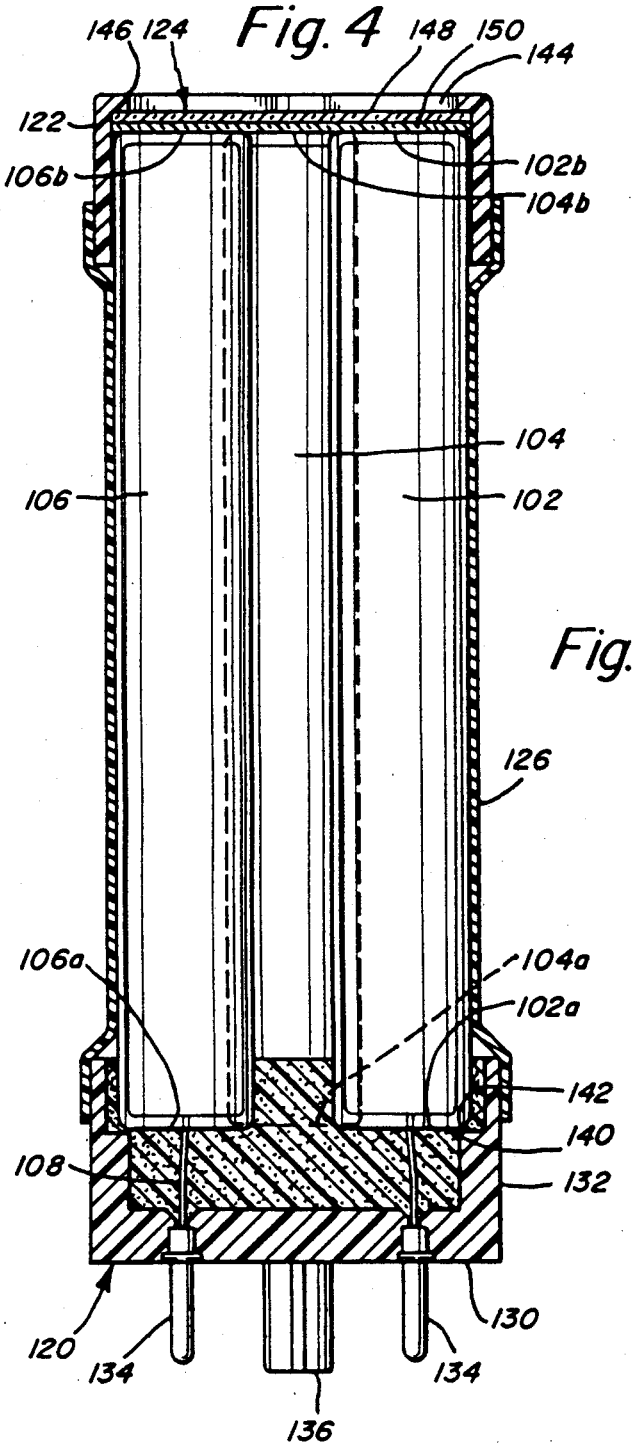
FIG. 4 a cross-sectional view of one embodiment a lamp assembly.
Figure 5:
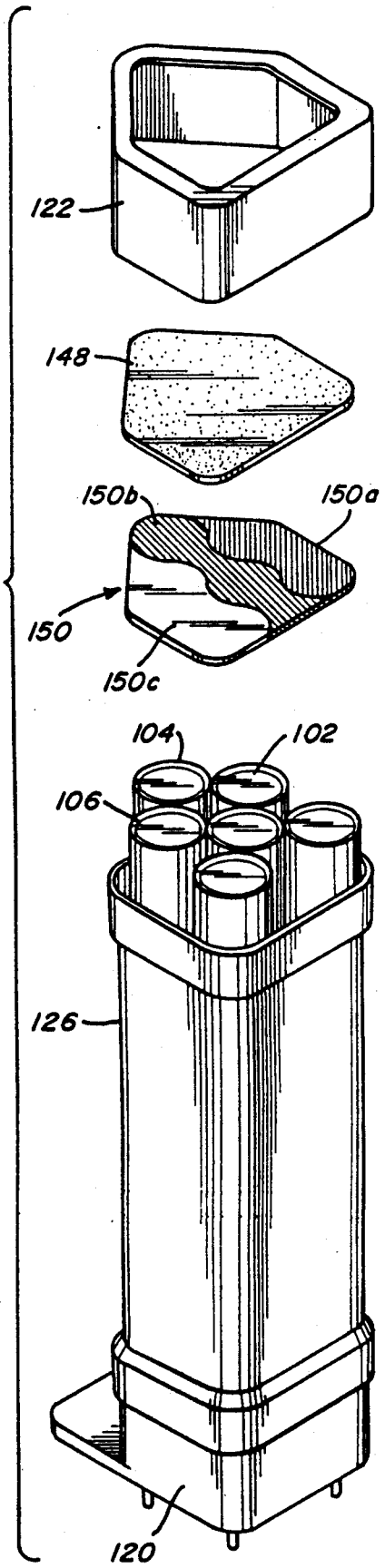
FIG. 5 a perspective view, partially exploded, lamp assembly of FIG. 4.
Figure 6:
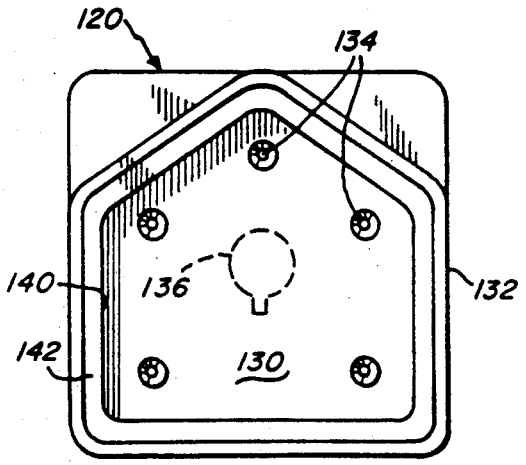
FIG. 6 elevation view of the base used in the lamp assembly.

A lamp assembly in accordance with the present invention is shown in FIGS. 4–6. A cross sectional view of the lamp assembly is shown in FIG. 4. The lamp assembly includes a red discharge lamp 102, a green discharge lamp 104 and a blue discharge lamp 106 in the configuration shown in FIG. 3B. Each discharge lamp includes a first end 102*a*, 104*a*, 106*a* having electrical leads 108 extending therefrom and a second end 102*b*, 104*b*, 106*b* through which light is emitted. The lamp assembly includes a plug-in base 120 for retaining the first ends 102*a*, 104*a*, 106*a* of the lamps and for plug-in electrical connection of the lamps. A cap 122 including a window means 124 is retained over the second ends 102*b*, 104*b*, 106*b* of the lamps. A sleeve 126 is disposed around the lamps 102, 104, 106. The sleeve 126 is coupled at one end to cap 122 and is coupled at the other end to base 120.

Base 120 includes a bottom wall 130 and a side wall 132 extending from bottom wall 130. Connector pins 134 are mounted in apertures in bottom wall 130 and provide means for plug-in electrical connection of the lamp assembly. The connector pins 134 mechanically support the lamp assembly on a circuit board or other suitable backplane. In addition, the connector pins 134 carry energizing power to discharge lamps 102, 104 and 106. In order to energize three discharge lamps, five connector pins 134 are required. The filaments at one end of each lamp are commonly connected to a source of electrical energy. The filaments can be connected in series, but are preferably connected in parallel so that the failure of one filament does not affect operation of the other lamps. Three other connector pins 134 are required for individually energizing the anodes of each of the lamps 102, 104, 106. The connector pins 134 can be of the hollow type. The leads from the appropriate lamps are inserted into the hollow connector pins 134 and are either soldered or crimped to form a permanent electrical connection.

Preferably, a guide pin 136 extends downwardly from bottom wall 130 and is slightly longer than connector pins 134. The guide pin 136 facilitates insertion of the lamp assembly into a socket.

The side wall 132 surrounds the first ends 102*a*, 104*a*, 106*a* of the discharge lamps and provides lateral support therefore. A ridge 140 extends inwardly from side wall 132 and defines a surface 142 against which the first ends 102*a*, 104*a*, 106*a* of the lamps rest. The thickness of side wall 132 is preferably minimized so that the lamp assemblies can be closely spaced in a display system. The base 120 is made of an insulating material that is resistant to the high temperatures associated with the lamps during operation. Examples of such materials include thermoplastic polyesters such as GE Valox or Mobay Pocan, polycarbonates such as LE Lexan, and polyetherimides such as GE Ultem. The base 120 is filled with a basing cement 143 for supporting the lamps and retaining them in position in the base. The basing cement is an alcohol-based or silicon based cement that foams and expands when it is activated.

The cap 122 includes an opening 144 for passage of light emitted by the lamps and an inwardly-extending peripheral lip 146 for retention of the window means 124. The window means 124 preferably includes a diffuser 148 and a filter 150. The diffuser 148 causes the light output from each lamp to be diffused and smoothed out, so that the individual lamps are less evident to the viewer. The filter 150 can include one or more filter regions for correcting the colors of the light from the lamps. The filter 150 includes a red filter region 150*a* aligned with red lamp 102, a green filter region 150*b* aligned with green lamp 104 and a clear region 150*c* aligned with blue lamp 106. Typically, the blue lamp 106 does not require color correction. The filter characteristics can be selected to provide desired color output characteristics. The diffuser 148 and the filter 150 can be attached to cap 122 with an adhesive or with a suitable arrangement of retention tabs in cap 122.

The sleeve 126 is a tubular member that surrounds the side walls of lamps 102, 104, 106 and interconnects the cap 122 and the base 120. In one preferred embodiment, the sleeve 126 is a heat-shrinkable tube that overlaps both the cap 122 and the side wall 132 of base 120. After heat-shrinking, one end of the tube surrounds a portion of cap 122 and retains it in place, and the other end of the tube surrounds a portion of side wall 132. Cap 122, sleeve 126 and base 120, in effect, provide a housing for the lamps 102, 104, 106. Polyvinylchloride, polyolefin and Teflon (polytetrafluoroethylene) are suitable materials for the heat-shrinkable tube.

Figure 7:
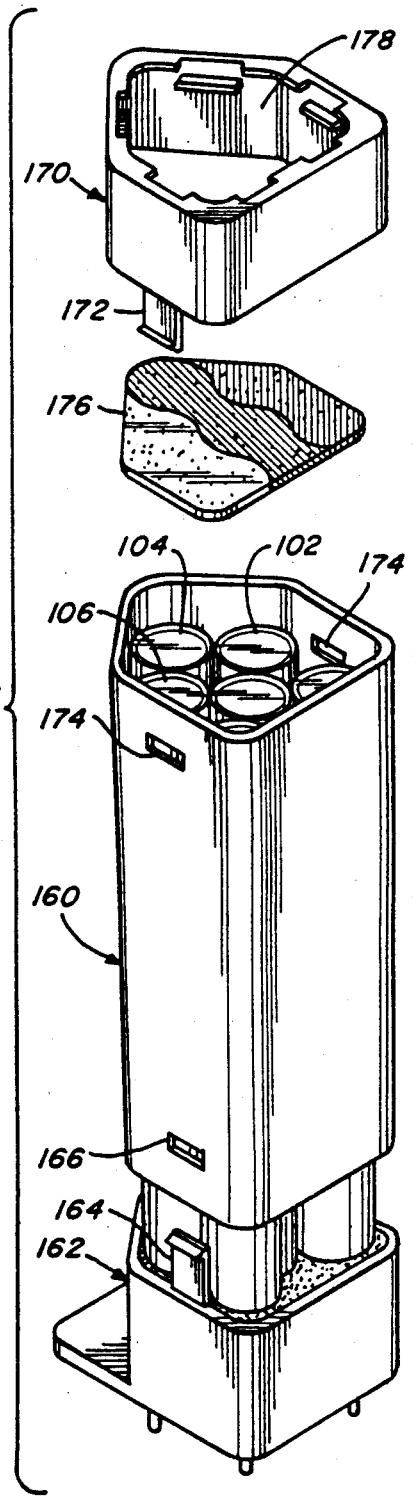
FIG. 7 a perspective, exploded view of another of a lamp assembly.

Referring now to FIG. 7, there is shown an alternate preferred embodiment of the lamp assembly. A sleeve 160 is a semi rigid plastic tube having the desired cross sectional shape and dimension. The sleeve 160 can be fabricated as an extrusion. A base 162 has the same structure as base 120 except that base 162 is provided with a pair of tabs 164 extending upwardly from the side wall. The tabs 164 are resilient and have projections at their ends which interlock with openings 166 in sleeve 160. A cap 170 has the same structure as cap 122 except that it is provided with tabs 172. The tabs 172 are resilient and have projections at their ends which interlock with openings 174 in sleeve 160. A window 176 for mounting in an opening 178 in cap 170 diffuses and filters the light emitted by the discharge lamps.

According to another embodiment, the cap 170 and the sleeve 160 can be formed as a single piece that slips over the lamps and interlocks to the base. A unitary cap and sleeve is preferably fabricated by injection molding.

In the above-described embodiments, the sleeve holds the cap and the base together as a unit. In addition, the sleeve blocks light emitted through the sides of the lamps. As a result, the baffling that was used between picture elements in prior art display systems is no longer required.

In still another embodiment, the cap 122 is cemented directly to the discharge lamps 102, 104, 106, and the sleeve for interconnecting the cap 122 and the base 120 is eliminated. When a sleeve is not used, light can be prevented from passing through the sides of the assembly by applying a high density coating such as paint to the sides of the lamps.

In a further variation of the lamp assembly, the filter 150, the diffuser 148 and the cap 122 are not utilized. The discharge lamps 102, 104, 106 are mounted in the base 120 as described previously, and a sleeve 126 or a high density coating is used to prevent light from passing through the sides of the lamp assembly.

It will be understood that when different lamp configurations are utilized as illustrated in FIGS. 3A–3C, the shape and dimensions of the base, the sleeve and the cap will be altered to Conform to the prescribed configuration. The lamp assembly of the present invention permits the lamps of a picture element to be mounted in an abutting configuration, while providing a convenient housing to facilitate handling and replacement. In the configuration of FIG. 3C, a single, multicolor discharge lamp is used in the lamp assembly. Furthermore, the light output from the discharge lamps is color corrected by means of a filter located in the cap. The sleeve surrounding the side walls of the lamps prevents lateral leakage of light between picture elements so that essentially all of the light from lamps 102, 104, 106 is transmitted through the window in the desired display direction.

Figure 8:
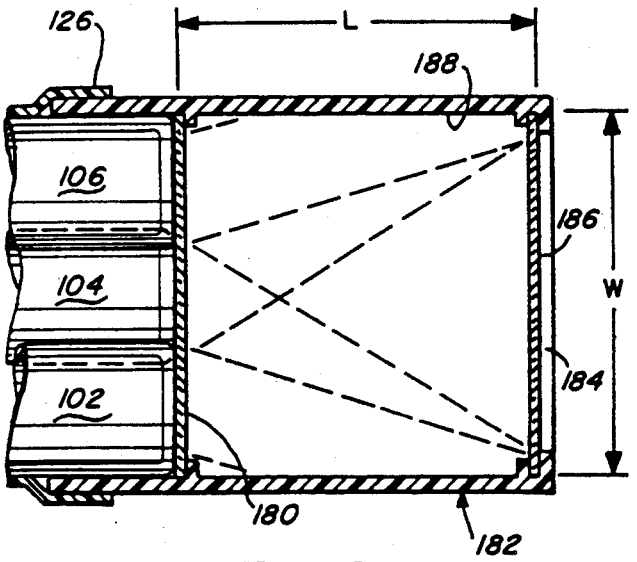
FIG. 8 a partial cross sectional view of a lamp assembly having a diffuser spaced from the ends of the lamps.

An alternate embodiment of the lamp assembly for improved picture quality is illustrated in FIG. 8. The lamp assembly is fragmented to show only the output ends of lamps 102, 104, 106 and a different cap arrangement from that described above. A filter 180 is positioned adjacent to the light output ends of lamps 102, 104, 106. A cap 182 has one end connected to sleeve 126 and includes an opening 184 for mounting of a diffuser 186. The cap 182 is elongated in the direction of light output so that the diffuser 186 is spaced from the ends of lamps 102, 104, 106 by a prescribed distance L. The diffuser 186 is spaced from the ends of the lamps in order to merge the light outputs from the lamps together at diffuser 186. As a result, the picture element has a relatively uniform color over its surface area. With this arrangement, the quality of the picture display is improved for viewers that are relatively close to the display. Rather than seeing a collection of different color spots, the outputs of the lamps are merged, and each pixel has the desired combination of colors over its entire surface area.

Referring to FIG. 8, it can be seen that each of the lamps 102, 104, 106 has a prescribed output radiation pattern, typically characterized by an angle of divergences. The length L of cap 182 is selected such that the radiation pattern from each of the lamps 102, 104, 106 approximately fills the area of diffuser 186. Thus, all of the lamps simultaneously illuminate diffuser 186, and the different colors are merged together. The inside wall 188 of cap 182 can be a reflecting surface so that incident light from the lamps is reflected through diffuser 186. Preferably, the length L of cap 182 is approximately equal to the width W of the pixel for best operation. If the length L is too short, merging will be incomplete and discrete areas of diffuser 186 will have different colors. If the length L is too long, the lamp assembly becomes unacceptably long and loss of light through scattering will occur. The diffuser 186 can be any diffusing layer, such as a translucent white mylar.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A lamp assembly for use as a picture element in an information display system, comprising:

low pressure arc discharge lamp means for selectively generating multiple colors, said lamp means having electrical leads extending from a first end thereof and a second end for output of light of different colors from discrete regions thereof;

a diffuser having a predetermined area; and means for mounting said diffuser in a spaced relationship to the second end of said lamp means at a distance therefrom selected such that the light from each different color region of said lamp means substantially fills the area of said diffuser, the distance between said diffuser and the second end of said discharge lamp means being at least as great as the maximum dimension of said diffuser, whereby the light outputs from said lamp means are merged at said diffuser.

2. A lamp assembly as defined in claim 1 wherein said lamp means includes a red discharge lamp, a green discharge lamp and a blue discharge lamp.

3. A lamp assembly as defined in claim 1 wherein said diffuser comprises a translucent sheet.

4. A lamp assembly as defined in claim 3 wherein said mounting means comprises a base coupled to the first ends of said discharge lamps for mechanical support and electrical interconnection thereof, a cap for holding said diffuser in spaced relationship to the second ends of said discharge lamps and means for coupling said cap to said base.

5. A lamp assembly as defined in claim 4 wherein said cap includes a cylindrical portion between the second ends of said discharge lamps and said diffuser, said cylindrical portion having a reflecting inside surface for directing light from said discharge lamps through said diffuser.

6. A lamp assembly as defined in claim, 5 further including filter means positioned adjacent to the second ends of said discharge lamps for altering the output spectrum of at least one of said discharge lamps.

7. A lamp assembly as defined in claim 2 wherein said mounting means comprises a cap for holding said diffuser in spaced relationship to the second ends of said discharge lamps and means for coupling said cap to said discharge lamps.

8. A plug-in lamp assembly for use as a picture element in an informational display system comprising:

a red discharge lamp, a green discharge lamp and a blue discharge lamp, each discharge lamp having electrical leads extending from a first end thereof and a light output region at a second end thereof.

a base including an insulating body and spaced-apart plug-in electrical connectors mounted in said insulating body, selected ones of the electrical leads of said lamps being connected to said electrical connectors;

a diffuser having a predetermined area;

a cap covering the second ends of said arc discharge lamps, said cap including a window for transmitting light from the second ends of said discharge lamps and means for mounting said diffuser in spaced relationship to the second ends of said discharge lamps at a predetermined distance therefrom selected such that the light from each of said discharge lamps substantially fills the area of said diffuser, the distance between said diffuser and the second ends of said discharge lamps being at least as great as the maximum dimension of said diffuser; and means for interconnecting said cap and said base.

9. A plug-in lamp assembly as defined in claim 8 wherein said cap includes a cylindrical portion between the second ends of said discharge lamps and said diffuser, said cylindrical portion having a reflecting inside surface for directing light from said discharge lamps through said diffuser.

10. A plug-in lamp assembly as defined in claim 8 wherein said means for interconnecting said cap and said base includes a cylindrical sleeve around said discharge lamps.

11. A lamp assembly for use as a picture element in an information display system comprising:

a red discharge lamp, a green discharge lamp and a blue discharge lamp, each discharge lamp having electrical leads extending from a first end thereof and a light output region at a second end thereof;

a base including an insulating body and spaced-apart electrical connectors mounted in said insulating body, selected ones of the electrical leads of said discharge lamps being connected to said electrical connectors;

a diffuser having a predetermined area; and means for mounting said diffuser in a spaced relationship to the second ends of said discharge lamps at a distance therefrom selected such that the light from each different color discharge lamp substantially fills the area of said diffuser, the distance between said diffuser and the second ends of said discharge lamps being at least as great as the maximum dimension of said diffuser, whereby the light outputs from said discharge lamps are merged at said diffuser.

12. A lamp assembly for use as a picture element in an information display system, comprising:

low pressure arc discharge lamp means for selectively generating multiple colors, said lamp means having electrical leads extending from a first end thereof and a second end for output of light of different colors from discrete regions thereof;

a diffuser having a predetermined area; and cap means for mounting said diffuser in a spaced relationship to the second end of said lamp means, the distance between said diffuser and the second end of said discharge lamp means being at least as great as the maximum dimension of said diffuser, said cap means including a reflecting inside surface between the second end of said discharge lamp means and said diffuser for directing light from said discharge lamp means through said diffuser.

13. A lamp assembly as defined in claim 12 wherein said lamp means includes a red discharge lamp, a green discharge lamp and a blue discharge lamp.

* * * * *